US009424714B2

(12) United States Patent
Moody

(10) Patent No.: US 9,424,714 B2
(45) **Date of Patent: *Aug. 23, 2016**

(54) CASINO GAME WITH NEXT ROUND MULTIPLIERS

(71) Applicant: IGT, Las Vegas, NV (US)

(72) Inventor: Ernest W. Moody, Las Vegas, NV (US)

(73) Assignee: IGT, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/833,998

(22) Filed: Aug. 24, 2015

(65) Prior Publication Data

US 2015/0364006 A1 Dec. 17, 2015

Related U.S. Application Data

(63) Continuation of application No. 14/182,321, filed on Feb. 18, 2014, now Pat. No. 9,147,321, which is a continuation of application No. 13/360,699, filed on Jan. 28, 2012, now Pat. No. 8,690,659, which is a continuation-in-part of application No. 12/616,145, filed on Nov. 11, 2009, now abandoned, which is a continuation-in-part of application No. 11/958,570, filed on Dec. 18, 2007, now Pat. No. 9,138,634.

(60) Provisional application No. 60/986,627, filed on Nov. 9, 2007, provisional application No. 60/875,812, filed on Dec. 18, 2006.

(51) Int. Cl.
*G07F 17/32* (2006.01)
*G07F 17/34* (2006.01)

(52) U.S. Cl.
CPC ..... *G07F 17/3244* (2013.01); *G07F 17/32* (2013.01); *G07F 17/3225* (2013.01); *G07F 17/3267* (2013.01); *G07F 17/3293* (2013.01); *G07F 17/34* (2013.01)

(58) Field of Classification Search
CPC ..... G07F 17/32
See application file for complete search history.

(56) References Cited

U.S. PATENT DOCUMENTS

| | | | |
|---|---|---|---|
| 5,332,219 | A | 7/1994 | Marnell et al. |
| 5,823,873 | A | 10/1998 | Moody |
| 6,120,378 | A | 9/2000 | Moody et al. |
| 6,149,521 | A | 11/2000 | Sanduski |
| 6,371,851 | B1 | 4/2002 | Singer et al. |
| 6,569,013 | B1 | 5/2003 | Taylor |
| 6,612,927 | B1 | 9/2003 | Slomiany et al. |
| 6,638,163 | B2 | 10/2003 | Moody |
| 6,811,486 | B1 | 11/2004 | Luciano |
| 6,857,957 | B2 | 2/2005 | Marks et al. |
| 7,247,091 | B2 | 7/2007 | Moody |
| 7,247,092 | B2 | 7/2007 | Jarvis et al. |

(Continued)

*Primary Examiner* — Omikar Deodhar
(74) *Attorney, Agent, or Firm* — Neal, Gerber & Eisenberg LLP

(57) ABSTRACT

A player plays a first round of a casino slot machine game. If the player achieves a winning outcome on the first round of play, the payouts for the next round of play of the casino game will be increased. The amount of the increase is based on the category of the winning outcome on the first round of play. Each subsequent round of play continues to have increased payouts if the player continues to achieve winning outcomes. When the player has a losing outcome, the payouts revert to the base level. An extra wager may be required from the player to activate this feature during the play of the casino game.

20 Claims, 7 Drawing Sheets

(56) References Cited

U.S. PATENT DOCUMENTS

| | | | |
|---|---|---|---|
| 7,819,740 | B2 | 10/2010 | Masci et al. |
| 8,277,305 | B2 | 10/2012 | Caputo et al. |
| 2003/0027626 | A1 | 2/2003 | Marks et al. |
| 2004/0053672 | A1 | 3/2004 | Baerlocher |
| 2005/0130737 | A1 | 6/2005 | Englman et al. |
| 2006/0194628 | A1 | 8/2006 | Novellie |

CASINO GAME WITH NEXT ROUND MULTIPLIERS

PRIORITY CLAIM

This application is a continuation of, and claims priority to and the benefit of, U.S. patent application Ser. No. 14/182,321, filed on Feb. 18, 2014, which is a continuation of, and claims priority to and the benefit of, U.S. patent application Ser. No. 13/360,699, filed on Jan. 28, 2012, which issued as U.S. Pat. No. 8,690,659 on Apr. 8, 2014, which is a continuation-in-part of, and claims priority to and the benefit of, U.S. patent application Ser. No. 12/616,145, filed on Nov. 11, 2009, now abandoned, which is a continuation-in-part of, and claims priority to and the benefit of, U.S. patent application Ser. No. 11/958,570, filed on Dec. 18, 2007, which claims priority to and the benefit of: (1) U.S. Provisional Patent Application No. 60/986,627, filed on Nov. 9, 2007, now expired; and (2) U.S. Provisional Patent Application No. 60/875,812, filed on Dec. 18, 2006, now expired, the entire contents of each of which are incorporated herein by reference.

BACKGROUND OF THE INVENTION

This invention relates primarily to casino games, and more particularly to casino games such as video poker, keno and slot machines The present invention provides the player with multipliers on the next round of play depending on the outcome of the previous round of play.

Conventional video draw poker is a single player game in which the player does not play against a dealer or other players, but rather merely tries to achieve the highest possible ranking poker hand.

After an initial deal of five cards, the player is allowed to discard and replace unwanted cards with replacement cards. Electronic video poker games use poker hand rankings to determine winning combinations and a payout schedule is used to determine the amount awarded to the player for achieving a winning combination.

The conventional winning poker hand rankings that are used in video poker in order from highest to lowest are: Royal Flush, Straight Flush, Four of a Kind, Full House, Flush, Straight, Three of a Kind, Two Pair and a Pair of Jacks or better. Any hand having less than a Pair of Jacks or better is a losing hand. These winning poker hand rankings are used in the Jacks or Better draw poker format as well as many of the other draw poker formats.

Video poker as a draw poker game using the Jacks or Better draw poker format has been played in gaming casinos for many years. Variations of video draw poker have evolved and include video draw poker using Jokers as wild cards and video draw poker using Deuces (or even Sevens) as wild cards. Another known variation of video draw poker is the Tens or Better format in which the lowest winning hand combination is a Pair of Tens. Most of the more recent modifications to video involve the use of different draw poker formats such as Bonus Poker, Double Bonus Poker, Double-Double Bonus Poker and even Triple Bonus Poker. Different draw poker formats involve changes to the pay table and often involve using different poker hand rankings as winning hand combinations.

Multiple hand video poker games allow the player to play more than one hand of video poker at a time. U.S. Pat. No. 5,823,873 to Moody, the disclosure of which is incorporated herein by reference, discloses a multiple hand poker game in which the player plays two or more hands of video poker at a time. An initial starting hand is dealt, the player discards unwanted cards and replacement cards are dealt for the discarded cards. The poker hand ranking of the final cards is determined and the player receives a payout for any winning card combination achieved. Each hand of the multiple hand poker game is treated as a separate pay line for payout purposes. However, each pay line uses the same pay table for the purpose of determining the amount received by the player for winning hands.

U.S. Pat. No. 6,638,163 (Moody) discloses a stud poker game with consecutive rounds of play. In either a single hand format or a multiple hand format, the play makes a wager to start the game. As long as the player continues to achieve winning outcomes, the play continues to receive additional rounds of stud poker without having to make any additional wagers. No pay table multipliers are disclosed in this method of play.

U.S. Pat. No. 6,149,521 (Sanduski) discloses randomly applying a multiplier to a pay line based on the value of a multiplier card. Sanduski discloses using only a single multiplier value for a single hand of video poker. For example, when a player achieves a Four-of-a-Kind, the payout for this winning combination is multiplied by the value of the kicker card in the poker hand. There is no carryover effect of any multiplier in the Sanduski game to the next round of play of the game.

U.S. Pat. No. 7,247,092 (Jarvis et al.), the disclosure of which is incorporated herein by reference, discloses the use of one or more multiplier cards added to a conventional deck of playing cards. Whenever a multiplier card appears during the play of a video poker game, the payout for any winning combination that is achieved is multiplied by the value of the multiplier card. This Jarvis feature has been commercialized in a game known as SUPER TIME PAY which is marketed by IGT of Reno, Nev. There is no carryover effect of any multiplier in the Jarvis game to the next round of play of the game.

The Jarvis multiplier card feature has been applied to multiple hand video poker. For example, in TRIPLE PLAY SUPER TIMES PAY all pay lines are eligible for the same multiplier value should a multiplier card appear in the initial deal of the starting hand. There is no carryover effect of any multiplier in the TRIPLE PLAY SUPER TIMES PAY game to the next round of play of the game.

U.S. Pat. No. 6,612,927 (Slomiany et al.) discloses a multiple hand poker game using multipliers. The player wagers to play four hands of video poker. The first hand is played at a 1× pay table. If the player has a winning outcome on the first hand, the player plays the second hand at a 2× multiplier. If the player has a winning outcome on the second hand, the player plays the third hand at a 4× multiplier. If the player has a winning outcome on the third hand, the player plays the fourth hand at an 8× multiplier. The multipliers from hand to hand always remain in the same progression of 1×, 2×, 4× and 8×.

U.S. Pat. No. 6,569,013 (Taylor) discloses a poker game which uses varying pay tables. As the player achieves a winning outcome on each consecutive round of play, the pay table changes for the next round of play. When the player achieves a losing outcome on a round of play, the pay table resets to the base pay table for the next round of play.

Slot machines also have one or more pay lines and for each pay line that has been activated by making a wager thereon, a player receives a payout whenever a winning symbol combination that appears on an active pay line.

U.S. Pat. No. 6,120,378 to Moody, the disclosure of which is incorporated herein by reference, discloses a multiple reel slot machine with multiple pay lines. The player makes a wager for each pay line that the player wishes to have activated for a particular round of play. The method of the present invention may be practiced using the slot machine disclosed in this '378 patent as well as other slot machines which have multiple pay lines.

The present invention provides a method for applying multipliers on the next round of play of a casino game based on the outcome of the previous round of play thereby adding a new and exciting wagering and winning feature for the player. The method of the present invention can be applied to draw poker games and to slot machines Stud poker games and keno games may also be modified to use the method of the present invention.

SUMMARY OF THE INVENTION

A player plays a first round of a casino game. If the player achieves a winning outcome on the first round of play, the payouts for the next round of play of the same casino game will be increased. The amount of the increase is based on the category of the winning outcome on the first round of play. Each subsequent round of play continues to have increased payouts if the player continues to achieve winning outcomes. When the player has a losing outcome, the payouts revert to the base level. An extra wager may be required from the player to activate this feature during the play of the casino game.

DETAILED DESCRIPTION OF THE PREFERRED EMBODIMENTS

Figure 1:
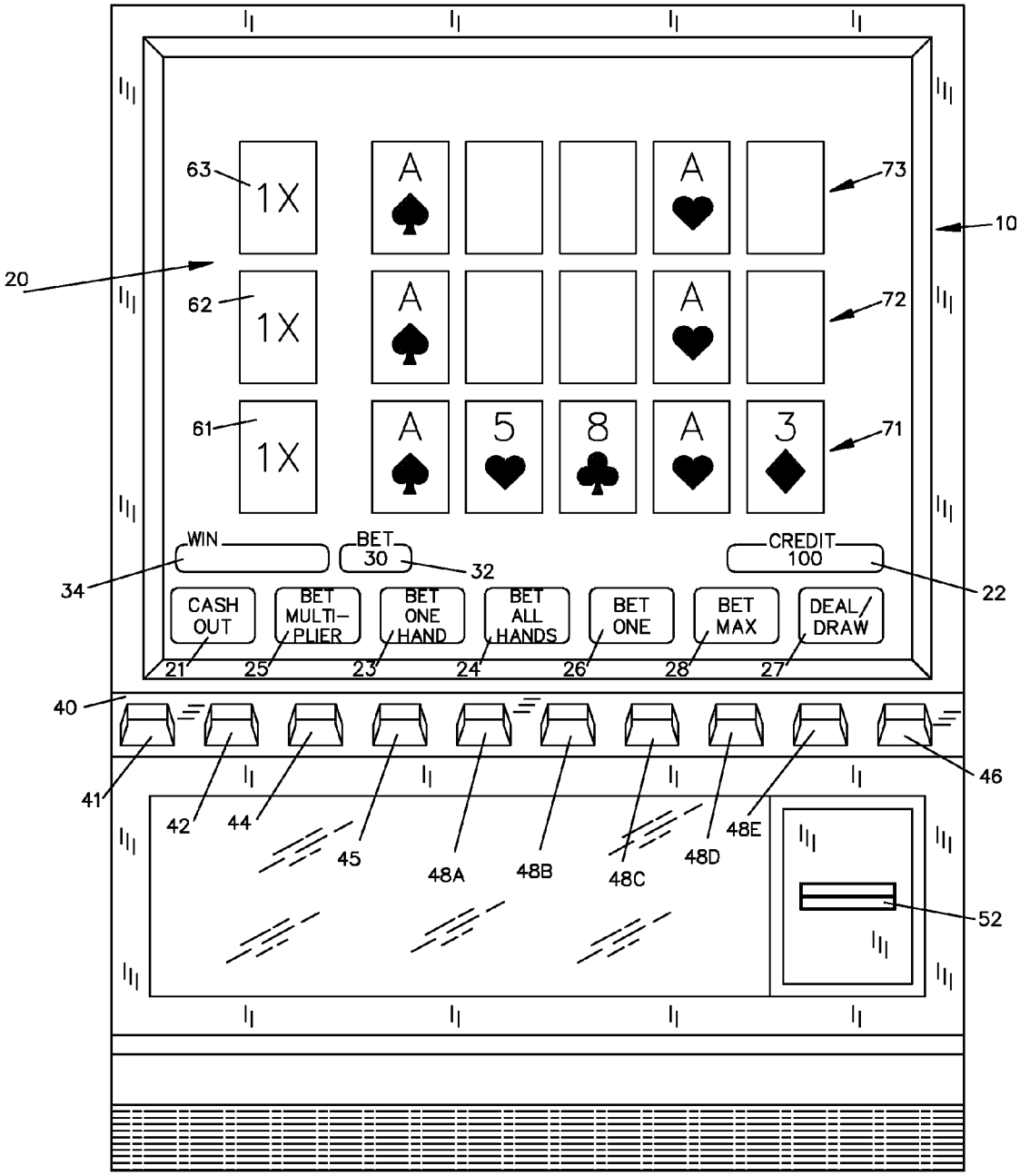
FIG. 1 shows a video poker machine configured to practice the present invention showing a representative initial deal of the cards of a multiple hand poker game for the first round of play.

The present invention relates to casino games such as video poker draw and stud games, keno games and slot machines FIG. 1 shows generally at 10 a typical electronic video poker machine that is configured to provide to the player the method of the present invention. A portion of the poker machine 10 includes a conventional video screen display 20 upon which the play of the poker game is shown.

The poker machine 10 also includes a conventional currency/ticket acceptor 52 by which the player can insert currency or tickets to add credits to a credit meter 22. It is also possible to provide a conventional coin head (not shown) to allow the player to add credits or make wagers by using coins or gaming tokens.

As is also conventional in electronic video poker machines, the credit meter 22 is provided to show the amount of credits that the player has accrued on the gaming machine 10—either by inserting coins, tokens, currency or tickets or from winning plays achieved by the player. Whenever the player makes a wager, the amount of the wager is decremented from the credit meter 22. Whenever the player achieves a winning play during the play of the game, the amount of the winning play is incremented on the credit meter 22.

A conventional payout hopper may also be located on the interior of the gaming machine and is used to dispense coins or tokens to the player into a payout tray (not shown) when the player wishes to collect any winning amounts the player has accrued. Other suitable and conventional payout mechanisms can be used, such as a ticket printer or other cashless payout devices.

A button panel 40 is also provided on the poker machine 10 and the buttons mounted on the button panel 40 are used by the player to control the operation of the poker machine 10. Any suitable configuration of the buttons on the button panel can be used and, alternatively, conventional touch screen technology can be used for any or all of the buttons mounted on the button panel.

A typical button arrangement is shown on the button panel 40 in FIG. 1. A "BET ONE" button 42 is provided to allow the player to wager one credit at a time. A "BET MAX" button 44 is provided to allow the player to wager the maximum amount of credits permitted by the configuration of the gaming machine 10. Any number of credits can be set as the maximum amount that it is possible to wager on each hand and, typically, five credits will be the maximum number of credits for any particular hand. Alternatively or additionally, a "BET ONE" location 26 and a "BET MAX" location 28 can be provided on the video screen 20 to allow the player to wager by using conventional touch screen technology.

The button panel 40 also includes a "CASH OUT" button 41 by which the player can effect the cashing out of any credits accrued on the credit meter 22. A touch screen "CASH OUT" location 21 may also be provided.

A conventional "DEAL/DRAW" button 46 is also provided on the button panel 40 which is used by the player to activate the initial deal of the cards at the deal stage of the method of play or the dealing of replacement cards at the draw stage of the method of play as is appropriate. Similarly, a DEAL/DRAW location 27 can be provided on the video screen 20 to allow the player to effect either the deal step or the draw step by using conventional touch screen technology.

The button panel 40 is also provided with five "CARD" buttons 48A, 48B, 48C, 48D and 48E associated with each horizontal card location on the video screen display: card button 48A is associated with the left most card location, card button 48B is associated with the second from the left card location, card button 48C is associated with the middle card location, card button 48D is associated with the second from the right card location and card button 48E is associated with the right most card location. Each card button is preferably aligned below the card locations so that the player can easily associate the appropriate card button with the appropriate card location. These card locations 48 are used by the player to select which cards to hold during the draw step of the poker game. Alternatively, the card locations on the video screen display 20 can be touch screen activated to allow the play to select which cards to hold by merely touching the card location on the video screen display 20.

A "BET ONE HAND" touch screen location 23 is provided on the video screen display 20 to allow the player to choose to play one hand of video poker. Each time the player presses the "BET ONE HAND" touch screen location 23 another hand of video poker is activated for that round of play. A "BET ALL HANDS" touch screen location 24 is also provided on the video screen display 20 to allow the play to activate all available hands of the multiple hand poker game with a single press. Associated buttons (not shown) may be provided on the button panel 40 to allow the player to bet one hand or to bet all hands.

The button panel 40 also includes a "BET MULTIPLIER" button 45 and an associated "BET MULTIPLIER" touch screen location 25 can be provided on the video screen display 20. This allows the player to activate the multiplier feature of the present invention during the play of the video poker game, if the use of the multiplier feature is optional during the play.

The video screen display 20 also has a "BET" location 32 that shows the amount of credits that have been wagered on a particular round of play and a "WIN" location 34 that shows the amount of credits won by the player on a particular round of play.

Each electronic video poker game is designed to be played by having one or more poker hands displayed on a video screen to a player. These are "player's hand only" poker games in which the player does not play against a dealer's hand or against other players, but merely attempts to achieve a winning poker hand combination using the player's final cards of the hand. Awards are made for winning final hand combinations based on the amount wagered by the player and the payouts that are displayed in a pay table.

An initial deal of cards comprises the player's initial hand. By manipulating the buttons on the gaming device or by using conventional touch screen technology, the player selects which cards he wishes to hold in his hand and thus which cards he wishes to discard. Replacement cards are then displayed for the discarded cards and the outcome of the play of the hand is determined. The resulting poker hand ranking of the final hand is then compared to a pay table to determine whether the player has a winning hand combination.

The method of the present invention will now be described. An initial hand is displayed to the player. The player is then allowed to discard any unwanted cards from the initial hand. Replacement cards for the discarded cards are displayed which results in a final hand. If the final hand has a winning card combination, the awards that can be won by the player on the next round of play are modified by an amount associated with the poker hand category of the winning card combination that was achieved in the final hand in the first round of play.

After the player has inserted an appropriate amount of coins, tokens, currency or tickets to add a sufficient amount of credits on the credit display meter 22, the player makes his initial wager. The player may press the "BET ONE" button 42 one or more times to bet in single increments or the player may merely press the "BET MAX" button 44 and the maximum number of credits are applied, for example, five credits are wagered on each of the three hands to be played and an additional five credits are wagered on each of the three hands to be played to activate the multiplier feature. The player can also use the touch screen locations to make his wager as described above.

As shown in FIG. 1, a player has made a thirty credit wager shown in the "BET" location 32. This activates three hands to be played HAND ONE 71, HAND TWO 72 and HAND THREE 73: five credits are allocated as the amount wagered on each hand and the additional five credits are required for the multiplier feature on each hand. In the preferred embodiment of the present invention, a player must make an extra wager to be eligible for the multiplier feature. The amount of the extra wager relates to the frequency and amount of the multipliers applied to the various pay lines. In a preferred embodiment of the present invention, the amount of the extra wager is equal to the amount of the wager made on a hand, although higher or lower amounts for the extra wager may be used. Alternatively, no extra wager could be required for the multiplier feature, but the pay table would have to be adjusted for the increased payouts that would come from the multiplier feature.

In the present invention, the multiplier feature does not apply to the present round of play, but applies to the next round of play. The player is making this wager on the present round of play to earn the possibility of receiving multipliers on the next round of play. At any point during the play of the game, if the player does not make the extra wager for a particular round of play, then the next round of play will occur at the base pay table having only a 1× multiplier.

Because FIG. 1 shows the initial first round of play, there is only a 1× multiplier on each hand. As shown in FIG. 1, a 1× multiplier 61 applies for HAND 71, a 1× multiplier 62 applies for HAND 72 and a 1× multiplier 63 applies for HAND 73. The payouts for any winning card combinations that are achieved on each of these pay lines are paid according to the associated pay table with only a 1× multiplier applied to those payouts. As discussed below, any multipliers that are earned during this first round of play are applied to the pay table for the next round of play.

The poker game shown in FIG. 1 as an example is a three hand poker game played in accordance with the method disclosed in U.S. Pat. No. 5,873,823.

The player has been dealt a first HAND 71 of the Ace of Spades, Five of Hearts, Eight of Clubs, Ace of Hearts and Three of Diamonds. The player has selected to hold the Ace of Spades and the Ace of Hearts and these two cards are duplicated into second HAND 72 and third HAND 73.

Figure 2:
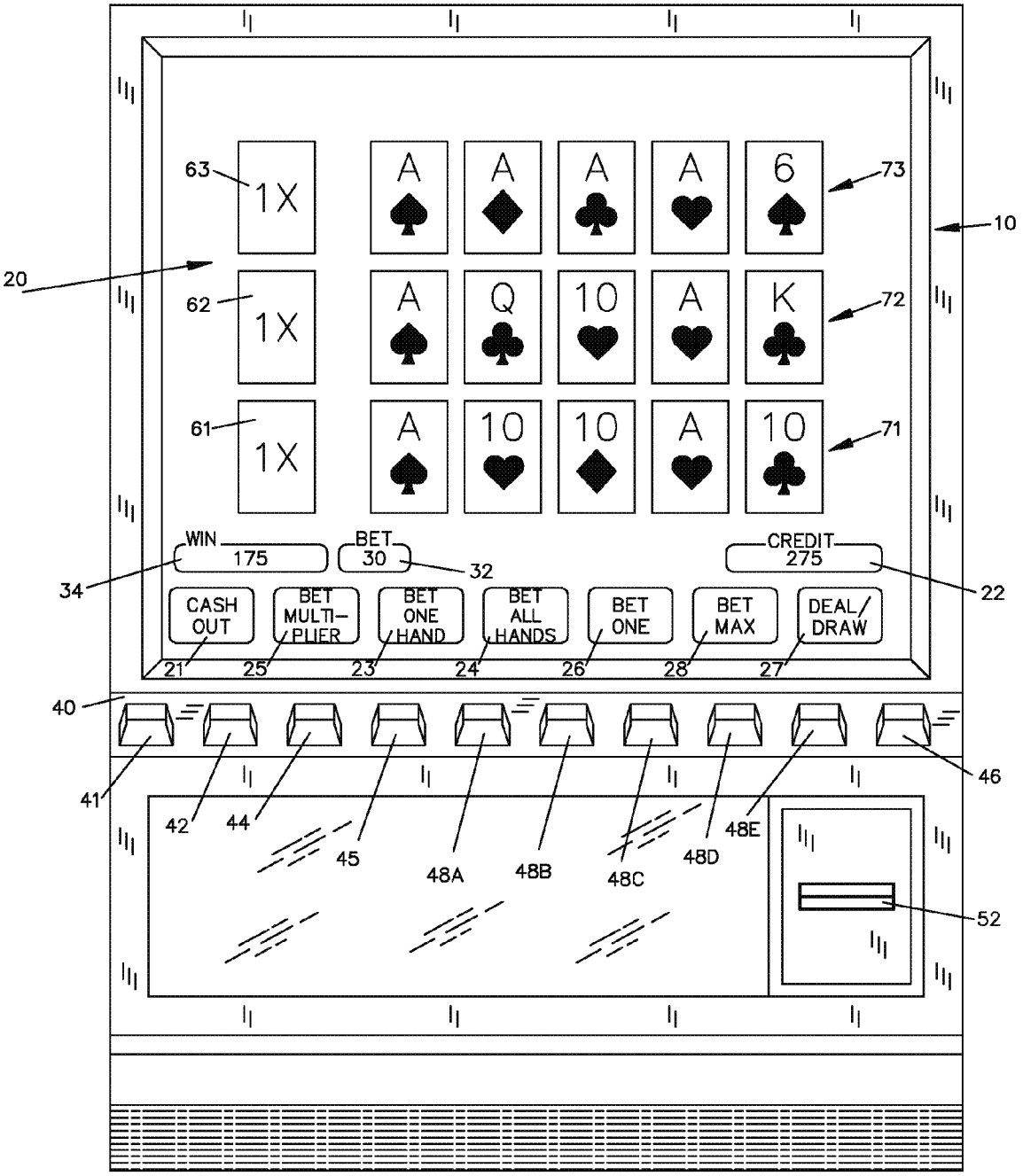
FIG. 2 shows a video poker machine configured to practice the present invention showing a representative display of the final hands of a multiple hand poker game for the first round of play.

As shown in FIG. 2, replacement cards for the discarded cards of first HAND 71 are displayed and the final first HAND 71 has a poker hand combination of a Full House. Additional cards are displayed into second HAND 72 and the final second HAND 72 has a poker hand combination of a Pair of Aces. Additional cards are displayed into third HAND 73 and the final third HAND 73 has a poker hand combination of Four Aces.

A pay table is displayed to the player showing the amounts that the player can win based on the poker hand ranking achieved by the player and the amount wagered by the player.

In the example shown in FIGS. 1 and 2, a Jacks or Better draw poker game format is used. A suitable pay table for this format would be:

TABLE 1

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5 |

Using the pay table shown in Table 1, final HAND 71 is a winning combination of a Full House and the player would receive forty-five credits as a payout based on the 1× multiplier 61. Final HAND 72 is a winning combination of Jacks or Better and the player would receive five credits as a payout based on the 1× multiplier 62. Final HAND 73 is a winning combination of Four-of-a-Kind and the player would receive one hundred twenty-five credits as a payout based on the 1× multiplier 63.

The multipliers to be applied to each hand in round two of the game are also determined based on the outcome of each hand in the first round. The multipliers are based on the various poker hand categories that are designated as winning hand combinations for the poker format being used. A multiplier table is used and could be displayed to the player on the video screen display 20, on a second screen display or printed on the glass of the gaming machine Any suitable multiplier table could be used. An exemplary multiplier table is shown in Table 2.

TABLE 2

| | |
|---|---|
| ROYAL FLUSH | 10X |
| STRAIGHT FLUSH | 10X |
| FOUR-OF-A-KIND | 10X |
| FULL HOUSE | 6X |
| FLUSH | 6X |
| STRAIGHT | 5X |
| THREE-OF-A-KIND | 4X |
| TWO PAIR | 4X |
| JACKS OR BETTER | 2X |

Figure 3:
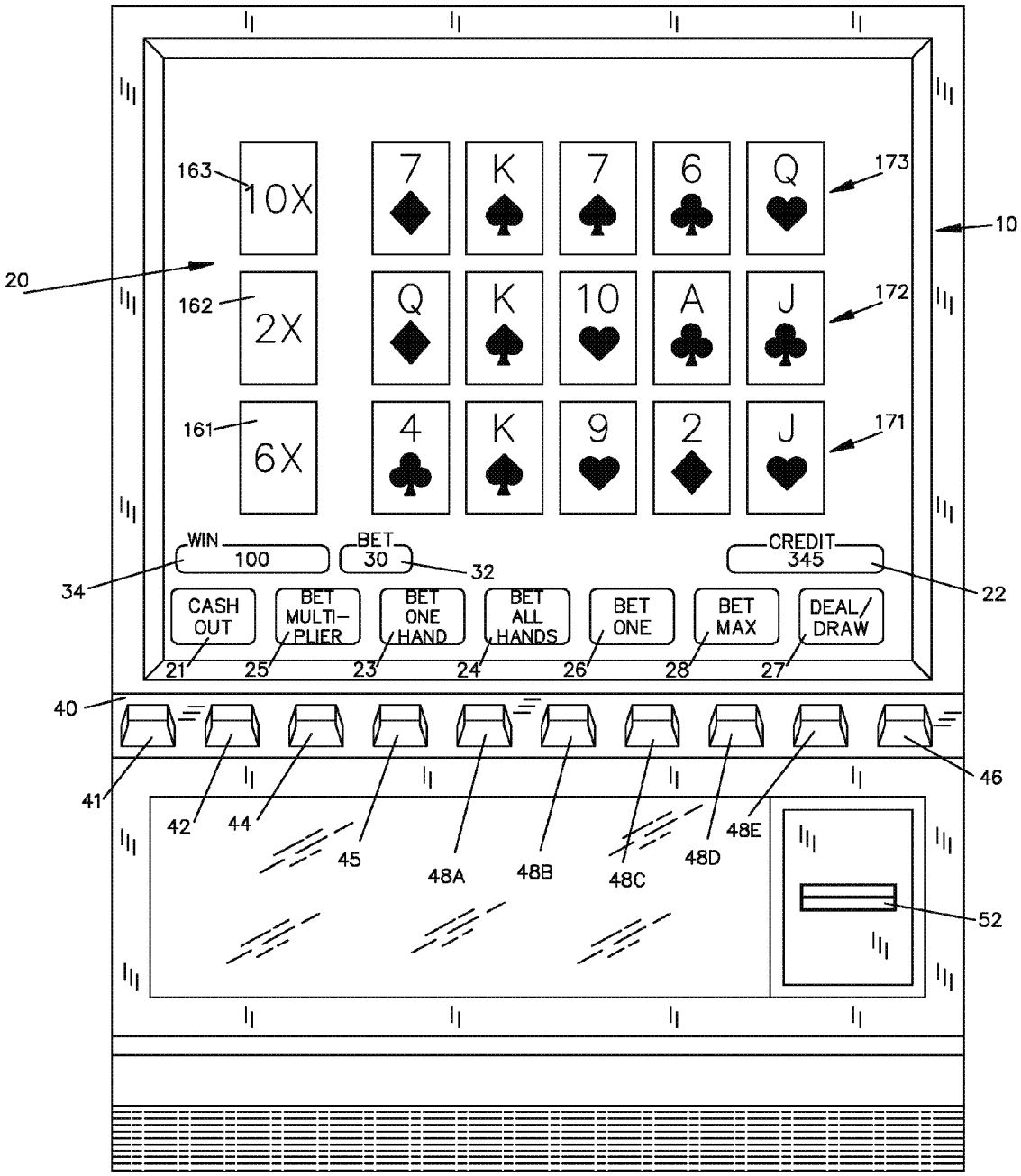
FIG. 3 shows a video poker machine configured to practice the present invention showing the multiplier feature as applied for the second round of play.

Using the multiplier table shown in Table 2, the winning outcome for a poker hand category of a Full House in HAND ONE 71 results in a 6× multiplier shown at 161 in FIG. 3 and applied to HAND ONE 171 in the next round of play. Likewise, the winning outcome for a poker hand category of Jacks or Better in HAND TWO 72 results in a 2× multiplier shown at 162 in FIG. 3 and applied to HAND TWO 172 in the next round of play. The winning outcome for a poker hand category of Four-of-a-Kind in HAND THREE 73 results in a 10× multiplier shown at 163 in FIG. 3 and applied to HAND THREE 173 in the next round of play.

Figure 4:
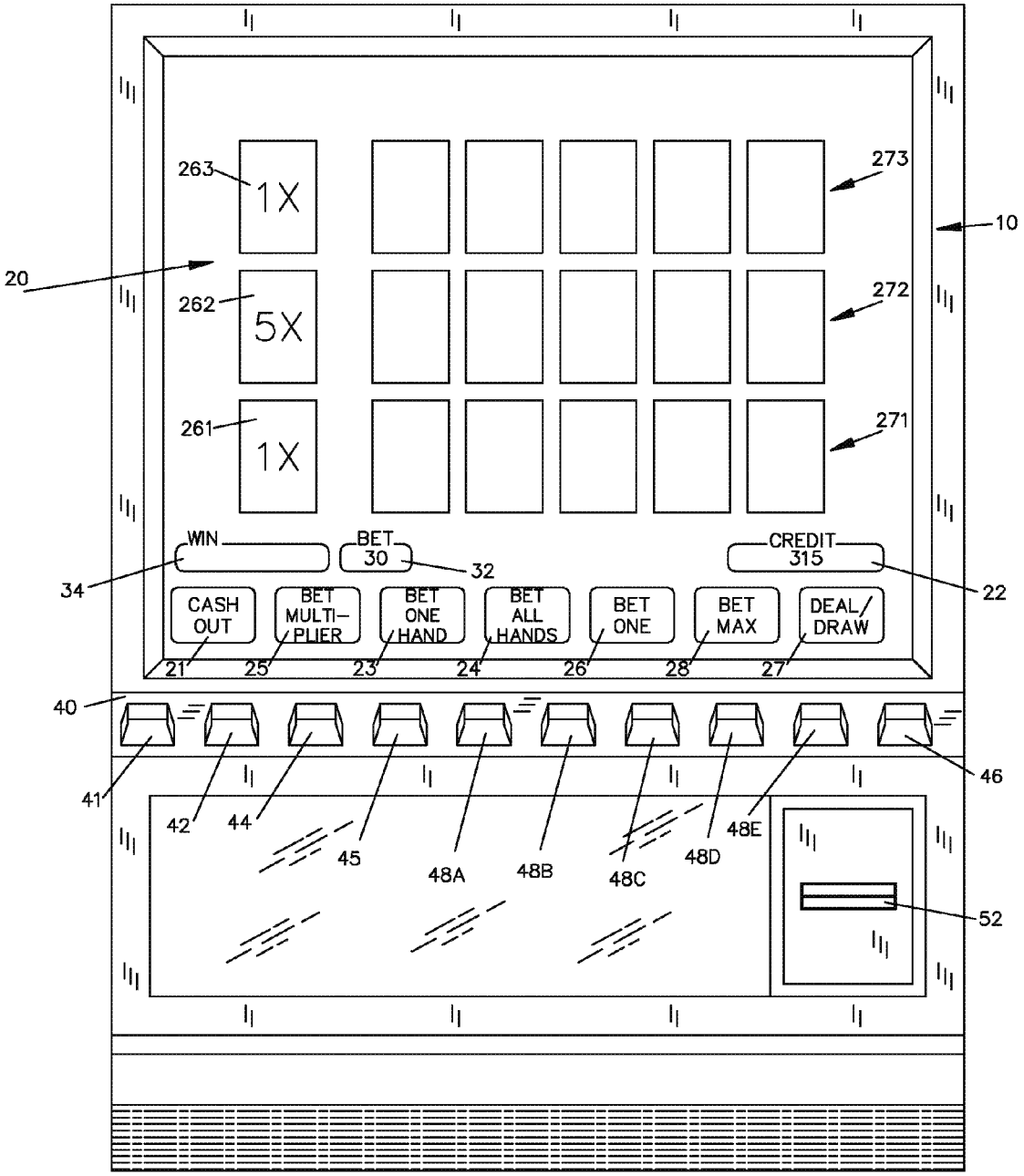
FIG. 4 shows a video poker machine configured to practice the present invention showing the multiplier feature as applied for the third round of play.

When the next round of play is conducted, the player would again make a wager of thirty credits and a round of video poker would be played. By making this thirty credit wager, the player is activating the multiplier feature for the next round of play. As the example in FIG. 3 shows, the player achieved a losing outcome in HAND ONE 171 so the multiplier feature reverts to 1× as shown in FIG. 4 at 261 for HAND ONE 271. The player achieved a winning outcome for a poker hand category of a Straight in HAND TWO 162 so the multiplier feature shows a 5× multiplier as shown in FIG. 4 at 262 for HAND TWO 272. Also, the player achieved a losing outcome in HAND THREE 173 so the multiplier feature reverts to 1× as shown in FIG. 4 at 263 for HAND THREE 273.

This progression of multipliers continues from round to round as long as the player continues to make the wager for the multiplier feature in the embodiment of the present invention which requires that the player make a wager to activate the multiplier feature.

Whenever the player achieves a losing hand combination on any hand of play, then the next hand of play would be played at the normal 1× payout.

While the examples shown in FIGS. 1 through 4 use a regular Jacks or Better draw poker format pay table, other pay tables have been developed for the other variations of draw poker, such as Deuces Wild Poker, Bonus Poker, Double Bonus Poker, Double Double Bonus Poker, Triple Bonus Poker, Joker's Wild Poker or any of the myriad of video poker formats that have been developed. Each of these video poker formats uses various arrangements of poker hand rankings as winning combinations and they use various payout amounts for the poker hand rankings. The amounts paid for the various winning hand combinations in each of the video poker formats are calculated to provide a certain theoretical game return based on the mathematical probability of achieving the winning hand combinations and the theoretical hold percentage that the casino wishes to offer to the players.

The method of the present invention can be applied to any of the various video poker formats that are available or can be created for use.

The multipliers for a poker hand category can also be varied as desired and can be applied to some or all of the poker hand categories that are winning hand combinations for the poker format being used.

While the example given above has been described in connection with a three hand video poker game, the present invention can also be applied to a single hand video poker game, or to any number of multiple hand video poker games.

The present invention can also be applied to stud poker games, keno games and slot machine games or any other casino game that uses a pay table.

The present invention has been described above in connection with a multiple hand draw poker game with the example using a three hand poker game. However, the multiplier feature of the present invention can also be used in single hand or single reel games or in any game that has two or more hands or reels.

A player plays a first round of a casino slot machine game. If the player achieves a winning outcome on the first round of play, the payouts for the next round of play of the casino game will be increased. The amount of the increase is based on the category of the winning outcome on the first round of play. Each subsequent round of play continues to have increased payouts if the player continues to achieve winning outcomes. When the player has a losing outcome, the payouts revert to the base level. An extra wager may be required from the player to activate this feature during the play of the casino game.

Figure 5:
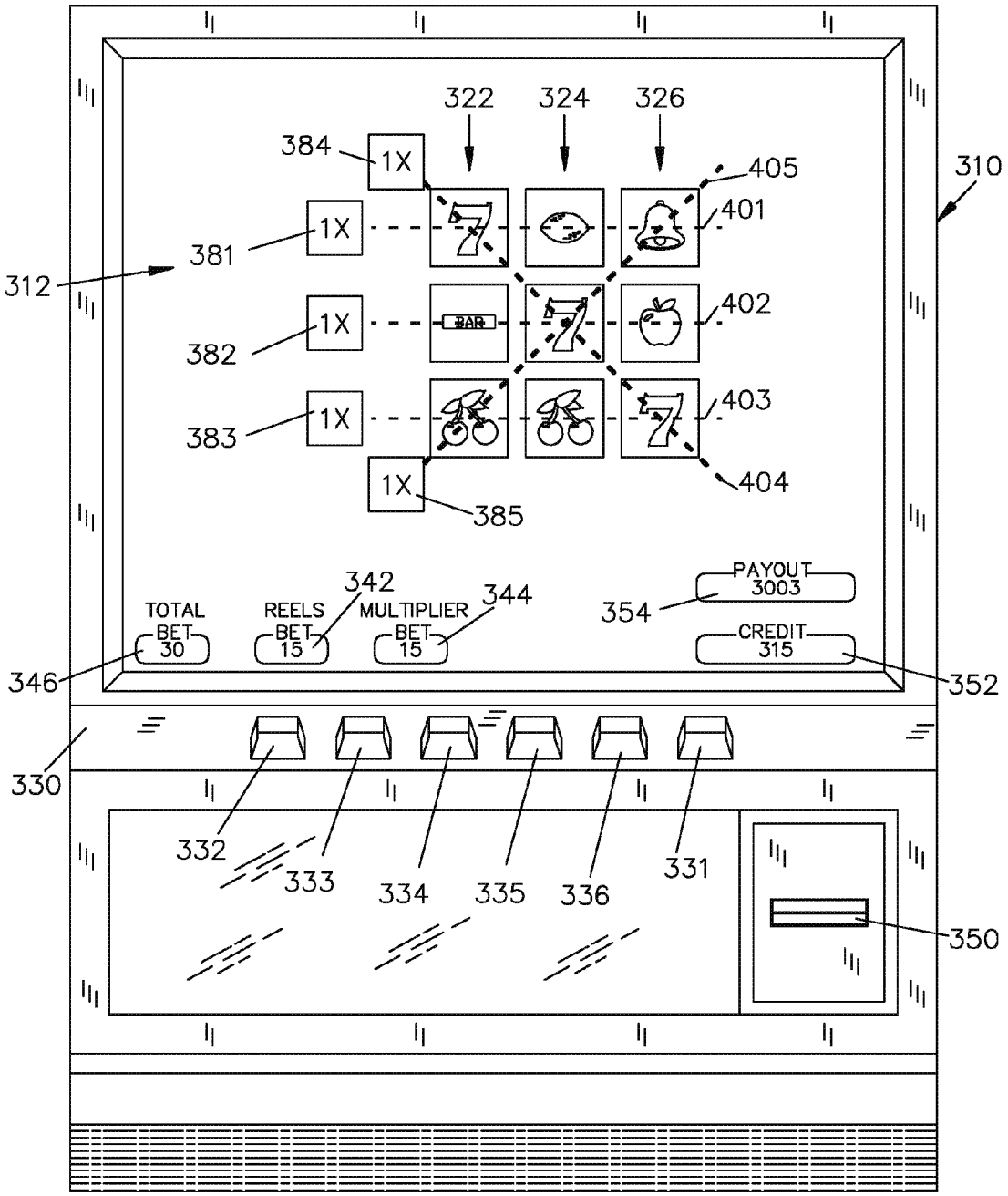
FIG. 5 shows a slot machine configured to practice the present invention and showing a first round of play.

FIG. 5 shows a slot machine 310 that has a plurality of reels with each reel having a plurality of symbols thereon and the slot machine has at least two pay lines that can be activated by the player.

FIG. 5 shows generally at 310 a typical electronic slot machine that is configured to provide to the player the method of the present invention. Alternatively, a typical mechanical reel slot machine can also be configured to effect the present invention. The slot machine 310 is configured similarly to the video poker machine shown in FIGS. 1-4.

A portion of the slot machine 310 includes a conventional video screen display 312 upon which the play of the slot game is shown. The slot machine 310 also includes a conventional currency/ticket acceptor 350 by which the player can insert currency or tickets to add credits to a credit meter 352. It is also possible to provide a conventional coin head (not shown) to allow the player to add credits or make wagers by using coins or gaming tokens.

A button panel 330 can be provided to allow the player to operate the slot machine 310 by engaging the buttons positioned on the button panel 330. Any number of suitable buttons may be used. FIG. 5 shows a SPIN button 331 by which the spin of the slot reels is effected by the player. A CASH OUT button 332 is used to allow the player to collect his remaining credits in a conventional manner. A BET ONE button 333 allows the player to wager one credit at a time and a BET MAX button 334 allows the player to wager the maximum number of credits permitted to play a round of the game. A BET PAY LINE button 335 is used by the player to select each of the pay lines upon which the player wishes to wager by activating a pay line for that round of the game. A BET MULTIPLIER button 336 allows the player to select each of the pay lines upon which the multiplier feature will be active for that round of the game. This allows the player to activate the multiplier feature of the present invention during the play of the slot machine game, if the use of the multiplier feature is optional during the play.

Instead of or in addition to using buttons on a button panel 330, various touch screen locations can be provided on the screen display 312 to allow the player to operate the slot machine, as is conventional. Location 354 shows the payout achieved for that round of play.

The screen display 312 also includes various locations that show game information to the player. Location 352 is the credit meter. Location 342 shows the reels bet amount for that round of play of the game and location 344 shows the multiplier bet for that round of play of the game. Location 346 shows the total bet made by the player for that round of the game.

The screen display 312 also shows the slot reels 322, 324, 326 which, in the example shown in FIG. 5, comprises a 3×3 slot reel arrangement. More or less slot reels may be used in any suitable matrix arrangement. A plurality of pay lines are also shown; in the example shown in FIG. 5, there are five pay lines 401, 402, 403, 404, 405. Each pay line has associated therewith a multiplier indicator 381, 382, 383, 384, 385 which designate the multiplier amount which is active for that pay line during the current round of play.

Similar to the method discussed above in connection with the video poker game of FIGS. 1-4, the slot reel game starts with 1× multipliers on each pay line for the first round of play. The multipliers for each subsequent round of play are determined by the outcome of the preceding round of play.

The method of playing a slot machine game uses a slot machine having at least one pay line and at least two reels, each reel having a plurality of symbols thereon. As shown in the example of play shown FIG. 5, there are three slot reels 322, 324, 326, with each slot reels displaying three symbols. Each slot reel may be a mechanical or an electronic representation of a reel as is conventional in either mechanical or electronic slot machines Each slot game has at least one pay line. In the example shown in FIG. 5, there are five pay lines 401, 402, 403, 404, 405. Any suitable pay line configuration may be used. As is conventional, a player activates each pay line by wagering one or more credits that are allocated to that pay line. When a winning symbol category results on an activated pay line, the player wins an award and a pay line multiplier is applied to that pay line for the next round of play. The amount of the pay line multiplier is determined by the particular winning symbol category that results on the pay line.

The method includes applying a pay line multiplier on a next round of play based on a winning symbol category appearing on a pay line of the slot machine during a first round of play.

Prior to the start of play of the slot machine, there is established a plurality of winning symbol combinations that are used in the slot machine game. Any suitable symbol combinations may be used as winning symbol combinations.

The slot game pays the player a preestablished award based on the amount of the player's wager if the winning symbols of any activated pay line comprise a predetermined symbol combination category.

There is also established a pay table that associates an award with each winning symbol combination category. For example, Table 3 shows a representative group of winning symbol categories and the payouts associated therewith:

TABLE 3

| WINNING SYMBOL CATEGORY | PAYOUT |
|---|---|
| THREE SEVENS | 1000 |
| THREE BARS | 100 |
| THREE BELLS | 20 |
| THREE APPLES | 5 |
| THREE ORANGES | 4 |
| THREE CHERRIES | 3 |
| TWO CHERRIES | 1 |
| ANY OTHER SYMBOLS | 0 |

The payout is for a single credit wagered and would be increased for each additional credit wagered. Any suitable combination of winning symbol categories and payouts may be used.

Also provided is a multiplier table that is used to determine the pay line multiplier that will be used on the next round of play.

For example, Table 4 shows a representative group of winning symbol categories and the multipliers associated therewith:

TABLE 4

| WINNING SYMBOL CATEGORY | PAYOUT |
|---|---|
| THREE SEVENS | 10X |
| THREE BARS | 6X |
| THREE BELLS | 5X |
| THREE APPLES | 4X |
| THREE ORANGES | 3X |
| THREE CHERRIES | 3X |
| TWO CHERRIES | 2X |
| ANY OTHER SYMBOLS | 1X |

The multiplier table shows a multiplier associated with each winning symbol category. The multipliers for a winning symbol category can also be varied as desired and can be applied to some or all of the winning symbol categories that are shown in the pay table such as Pay Table 3.

At the start of the slot game, each multiplier to be used on the first round of play is 1×. This is shown in FIG. 5 at a multiplier location 381, 382, 383,384, 385 in the screen display 312.

After the player has inserted an appropriate amount of coins, tokens, currency or tickets to add a sufficient amount of credits on the credit display meter 352, the player makes his initial wagers. The player makes wagers before the reels are spun. The player wagers at least one credit on each pay line that the player wishes to activate for that round of the slot game. If a wager is required to activate the multiplier feature, the player also wagers at least one credit for the multiplier feature on each activated pay line.

The player may press the BET ONE button 333 one or more times to bet in single increments or the player may merely press the BET MAX button 334 and the maximum number of credits are applied, for example, five credits are wagered on each of the five pay lines to be activated and played and an additional three credits are wagered on each of the five pay lines to be played to activate the multiplier feature on each pay line. Alternatively or additionally, a "BET ONE" location (not shown) and a "BET MAX" location (not shown)

can be provided on the video screen 312 to allow the player to wager by using conventional touch screen technology.

Any number of credits can be set as the maximum amount that it is possible to wager on each pay line and, typically, three credits will be the maximum number of credits for any particular pay line.

As shown in the example in FIG. 5, the player has wagered 15 credits on the pay lines which is shown in the REELS BET location 342. The player has also wagered 15 credits on the multiplier feature as shown in the MULTIPLIER BET location 344. This multiplier bet is associated with the five activated pay lines.

In a preferred embodiment, a player must make an extra wager to be eligible for the multiplier feature. The amount of the extra wager relates to the frequency and amount of the multipliers applied to the various pay lines. In a preferred embodiment of the present invention, the amount of the multiplier feature wager is equal to the amount of the wager made on a pay line, although higher or lower amounts for the extra wager may be used. Alternatively, no extra wager could be required for the multiplier feature, but the pay table would have to be adjusted.

In the present invention, the multiplier feature does not apply to the present round of play, but applies to the next round of play. The player is making this multiplier feature wager on the present round of play to earn the possibility of receiving increased multipliers on the next round of play. At any point during the play of the game, if the player does not make the extra multiple feature wager for a particular round of play, then the next round of play will occur at the base pay table having only a 1× multiplier on each pay line.

This progression of multipliers continues from round to round as long as the player continues to make the wager for the multiplier feature in the embodiment of the present invention which requires that the player make a wager to activate the multiplier feature. Whenever the player achieves a losing hand combination on any pay line of play, then the next round of play would be played at the normal 1× payout for that pay line.

After the player has made the desired wagers, the slot machine is caused to spin the reels. As is conventional, when the reels stop spinning, a plurality of randomly selected symbols are displayed to the player along each pay line.

Whether a winning symbol category appears on an activated pay line is now determined.

As shown in the example in FIG. 5, pay line 401 has a Seven, a Lemon and a Bell. Pay line 402 has a Bar, a Seven and an Apple. Pay line 403 has two Cherries and a Seven. Pay line 404 has three Sevens. Pay line 405 has a Cherry, a Seven and a Bell. With reference to Table 3, pay line 403 has two Cherries which is a winning symbol category. Pay line 404 has three Sevens which is a winning symbol category. The other three pay lines do not have winning symbol categories.

When a winning symbol combination appears on an activated pay line, the player is provided with an award from the pay table. With regard to FIG. 5, the player has wagered three credits on pay line 403 and receives an award of three credits for the two Cherry winning symbol category. The player has also wagered three credits on pay line 404 and receives an award of three thousand credits for the three Sevens winning symbol category. The total payout of three thousand three credits is shown at Payout location 354.

Figure 6:
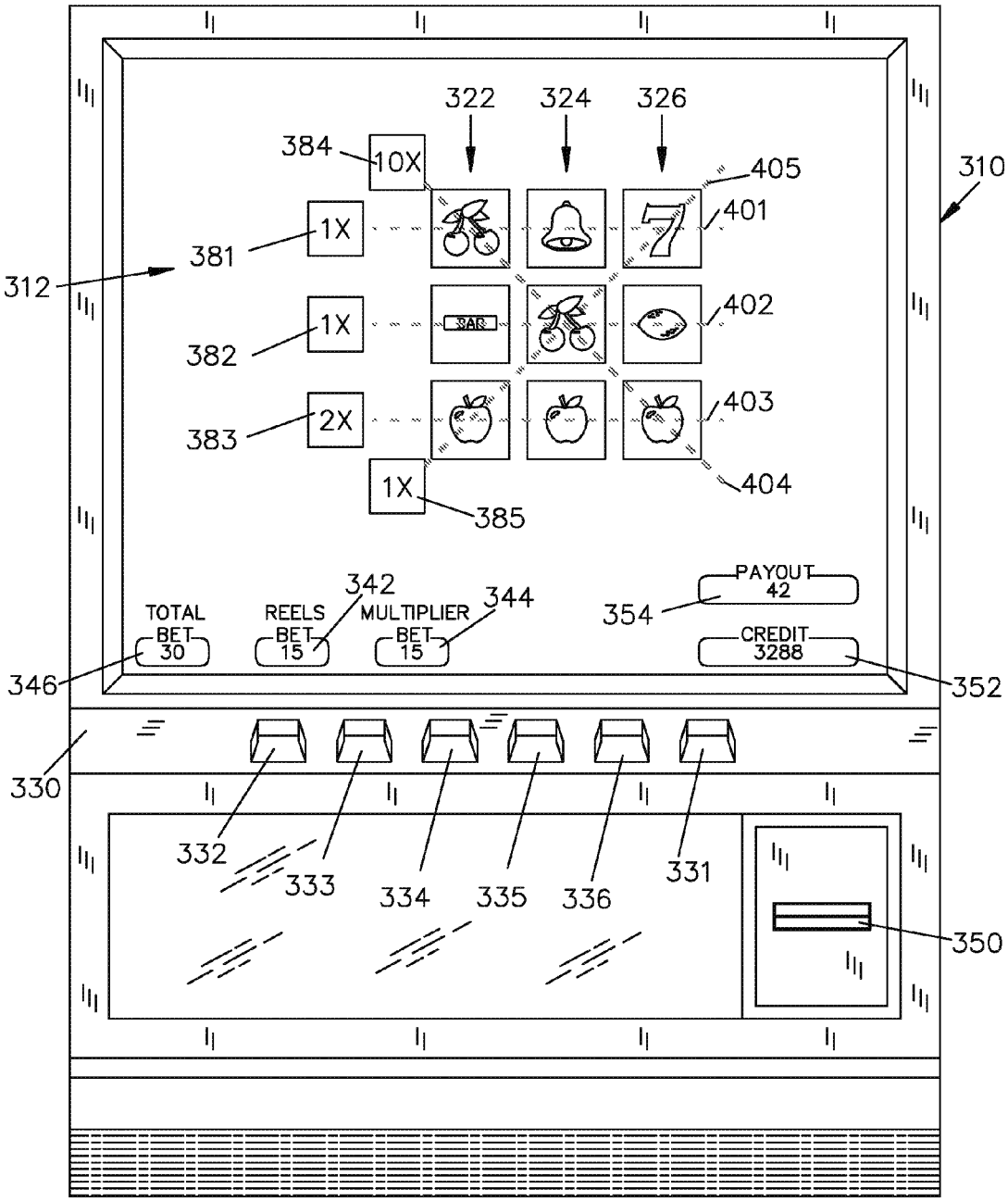
FIG. 6 shows a slot machine configured to practice the present invention and showing a next round of play.

There is also determined from the multiplier table the multiplier that is used on a next round of play for each pay line. With reference to Table 4, and as shown in FIG. 6, pay line 403 now has a multiplier of 2× based on the two Cherry winning symbol category achieved in the first round of play shown in FIG. 5. Pay line 404 now has a multiplier of 10× based on the three Sevens winning symbol category achieved in the first round of play shown in FIG. 5. The other three pay lines remain at a 1× multiplier since they did not any winning symbol categories in the first round of play shown in FIG. 5.

The next round of play starts when the player makes the wagers he desires of the next round of play. The next round of play occurs using the multipliers determined in the first round of play, the multiplier being applied to each activated pay line as described above. FIG. 6 shows an example of the result from the next round of play.

As shown in the example in FIG. 6, pay line 401 has a Cherry, a Bell and a Seven. Pay line 402 has a Bar, a Cherry and a Lemon. Pay line 403 has three Apples. Pay line 404 has two Cherries and an Apple. Pay line 405 has an Apple, a Cherry and a Seven. With reference to Table 3, pay line 403 has three Apples which is a winning symbol category. Pay line 404 has two Cherries which is a winning symbol category. The other three pay lines do not have winning symbol categories.

When a winning symbol combination appears on an activated pay line, the player is provided with an award from the pay table. With regard to FIG. 6, the player has wagered three credits on pay line 403 and receives an award of fifteen credits for the three Apples winning symbol category. The player has also wagered three credits on pay line 404 and receives an award of three credits for the two Cherries winning symbol category. The total payout of eighteen credits is shown at Payout location 354.

Figure 7:
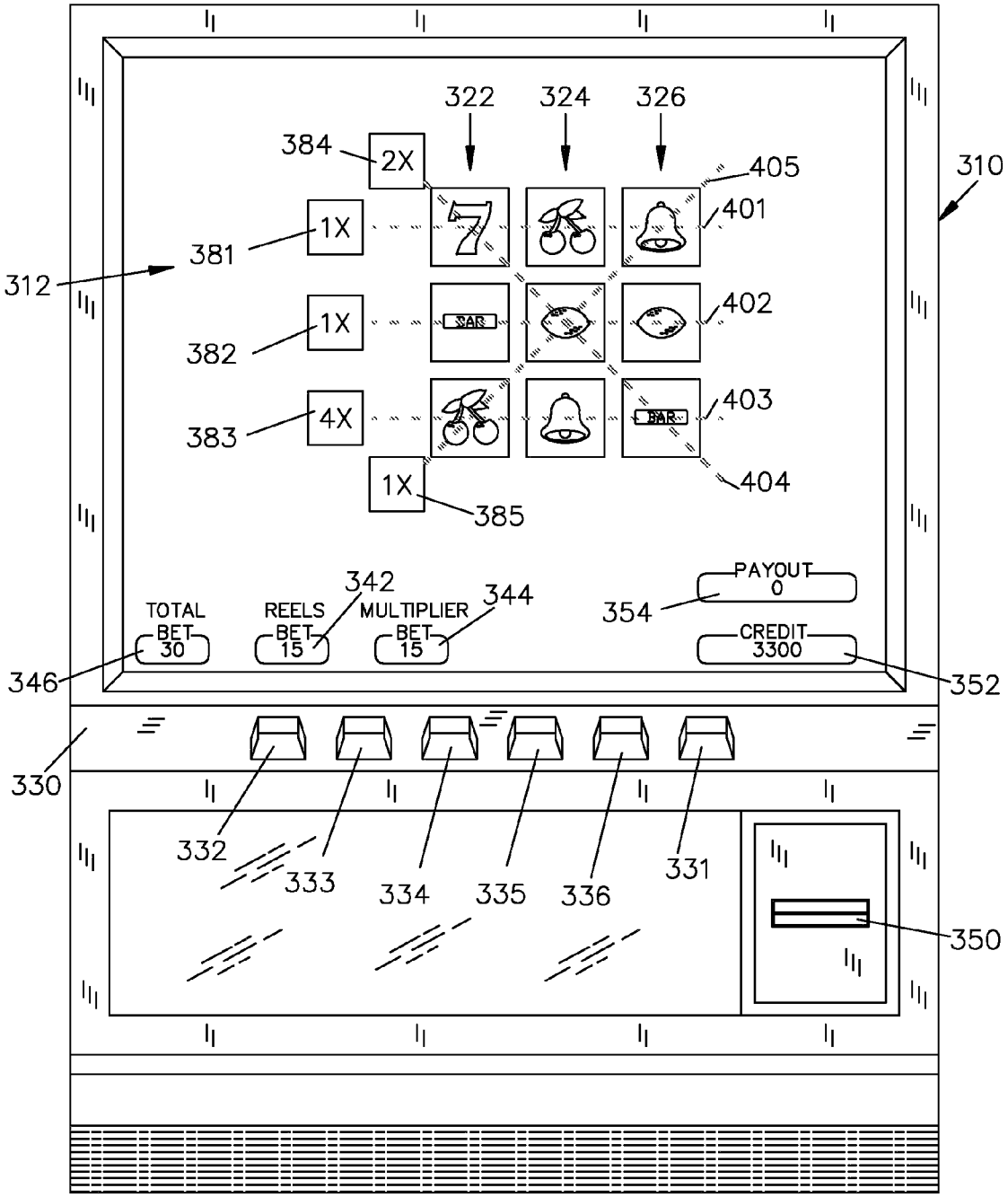
FIG. 7 shows a slot machine configured to practice the present invention and showing another next round of play.

There is also determined from the multiplier table the multiplier that is used on a next round of play for each pay line. With reference to Table 4, and as shown in FIG. 7, pay line 403 now has a multiplier of 4× based on the three Apples winning symbol category achieved in this next round of play shown in FIG. 6. Pay line 404 now has a multiplier of 2× based on the two Cherries winning symbol category achieved in this next round of play shown in FIG. 6. The other three pay lines remain at a 1× multiplier since they did not any winning symbol categories in this next round of play shown in FIG. 6.

Another next round of play is shown in FIG. 7.

As shown in the example in FIG. 7, pay line 401 has a Seven, a Cherry and a Bell. Pay line 402 has a Bar and a two Lemons. Pay line 403 has a Cherry, a Bell and a Bar. Pay line 404 has a Seven, a Lemon and a Bar. Pay line 405 has a Cherry, a Lemon and a Bell. With reference to Table 3, all five pay lines do not have winning symbol categories.

Since none of the pay lines has a winning symbol category, all of the multiplier locations would reset to 1× for yet another round of play of the slot game. Also since there are no winning symbol categories on any activated pay line, there is no payout as shown in Payout location 354 in FIG. 7. Since there were no winning symbol categories on this round of play, the multiplier for each pay line on a subsequent round of play would be 1×.

The invention comprises a method of playing a slot machine game that uses a slot machine having at least one pay line and at least two reels, each reel having a plurality of symbols thereon, and the method including applying a pay line multiplier on a next round of play based on a winning symbol combination appearing on a pay line of the slot machine during a first round of play comprising:

a) establishing a plurality of winning symbol combinations that are used in the slot machine game;

b) establishing a pay table that associates an award with each winning symbol combination category;

c) on the first round of play, providing a multiplier table that is used to determine the pay line multiplier that is used on the next round of play;

d) the multiplier table having a multiplier associated with each winning symbol combination category;

e) randomly selecting and displaying to a player a symbol on each reel on each pay line;

f) determining when a winning symbol combination appears on each pay line;

g) when a winning symbol combination appears on a pay line, providing the player an award from the pay table and also determining from the multiplier table the multiplier that is used on a next round of play; and h) playing the next round of play using the multiplier determined in the first round of play, the multiplier being applied to each pay line.

The method includes:

a) a player making a first wager on the at least first pay line;

b) paying the player a preestablished award based on the first wager if the winning symbols of the first pay line comprise a predetermined symbol combination category of the pay table.

The method includes the award being modified by using a multiplier. The method includes the player making a wager to be eligible for the multiplier.

The invention is claimed as follows:

1. A video poker machine comprising:

a housing;

a plurality of input devices supported by the housing, the plurality of input devices including an acceptor;

at least one display device supported by the housing;

at least one processor; and at least one memory device that stores a plurality of instructions that, when executed by the at least one processor, cause the at least one processor to operate with the at least one display device and the plurality of input devices to:

(a) establish a credit balance based at least in part on a monetary value associated with a physical item after the physical item is received by the acceptor;

(b) place a wager on a play of a card game after an actuation of a wager button is received, the credit balance being decreasable by the wager;

(c) randomly determine and display face-up a first hand including a plurality of cards;

(d) enable selection of none, one, a plurality, or all of the cards of the first hand to be held;

(e) display one or more additional hands each including each of any held cards of the first hand;

(f) if all of the cards of the first hand are held, designate each hand as complete;

(g) if fewer than all of the cards of the first hand are held:

(1) discard each non-held card of the first hand;

(2) complete the first hand by, for each discarded card of the first hand, randomly selecting a card and replacing said discarded card with the randomly-selected card; and (3) for each of the one or more additional hands, complete said additional hand such that said additional hand includes the same quantity of cards as the first hand;

(h) for each complete hand, if said complete hand is associated with one of a plurality of different poker hand categories:

(1) determine any awards for said complete hand, the credit balance being increasable by any determined awards; and (2) if a next play multiplier condition is satisfied, determine, based on the poker hand category with which said complete hand is associated, a multiplier usable in a hand corresponding to said complete hand in a next play of the card game; and (i) initiate a payout associated with the credit balance after an actuation of a cashout button is received.

2. The video poker machine of claim 1, wherein the next play multiplier condition is satisfied when the wager is a designated wager.

3. The video poker machine of claim 1, wherein the plurality of instructions, when executed by the at least one processor, cause the at least one processor to, for each complete hand, if said complete hand is associated with one of the plurality of different poker hand categories, determine any awards for said complete hand based at least in part on a paytable.

4. The video poker machine of claim 3, wherein the plurality of instructions, when executed by the at least one processor, cause the at least one processor to, for each complete hand, if said complete hand is associated with one of the plurality of different poker hand categories, determine any awards for said complete hand based at least in part on any multiplier for said hand determined in a prior play of the card game.

5. The video poker machine of claim 1, wherein each poker hand category is associated with one of a plurality of different multipliers.

6. The video poker machine of claim 5, wherein a first poker hand category is associated with a first multiplier and a second more valuable poker hand category is associated with a second greater multiplier.

7. The video poker machine of claim 1, wherein the plurality of instructions, when executed by the at least one processor, cause the at least one processor to:

place a second wager on the next play of the card game after a second actuation of the wager button is received;

repeat (c) to (g)(3); and for each complete hand, if said complete hand is associated with one of the plurality of different poker hand categories:

(1) determine any awards for said complete hand based at least in part on any multiplier for said hand determined in the prior play of the card game, the credit balance being increasable by any determined awards; and (2) if the next play multiplier condition is satisfied, determine, based on the poker hand category with which said complete hand is associated, a multiplier usable in a hand corresponding to said complete hand in a next play of the card game.

8. The video poker machine of claim 1, wherein the plurality of instructions, when executed by the at least one processor, cause the at least one processor to randomly determine the cards of the first hand from a set of a plurality of cards.

9. The video poker machine of claim 8, wherein the plurality of instructions, when executed by the at least one processor, cause the at least one processor to, if fewer than all of the cards of the first hand are held:

complete the first hand by, for each discarded card of the first hand, randomly selecting one of the remaining cards of the set of the plurality of cards and replacing said discarded card with the randomly-selected card; and for each of the one or more additional hands, complete said additional hand by randomly selecting one or more of cards and adding said one or more randomly-selected cards to said additional hand, wherein if the one or more additional hands include a plurality of additional hands, the one or more cards added to the additional hands are randomly selected from different card sets.

10. A method of operating a video poker machine, said method comprising:

(a) establishing, by at least one processor, a credit balance based at least in part on a monetary value associated with a physical item after the physical item is received by an acceptor of the video poker machine;

(b) placing, by the at least one processor, a wager on a play of a card game after an actuation of a wager button is received, the credit balance being decreasable by the wager;

(c) randomly determining, by the at least one processor, and displaying face-up, by at least one display device, a first hand including a plurality of cards;

(d) enabling selection of none, one, a plurality, or all of the cards of the first hand to be held;

(e) displaying, by the at least one display device, one or more additional hands each including each of any held cards of the first hand;

(f) if all of the cards of the first hand are held, designating, by the at least one processor, each hand as complete;

(g) if fewer than all of the cards of the first hand are held:

(1) discarding, by the at least one processor, each non-held card of the first hand;

(2) completing, by the at least one processor, the first hand by, for each discarded card of the first hand, randomly selecting a card and replacing said discarded card with the randomly-selected card; and (3) for each of the one or more additional hands, completing, by the at least one processor, said additional hand such that said additional hand includes the same quantity of cards as the first hand;

(h) for each complete hand, if said complete hand is associated with one of a plurality of different poker hand categories:

(1) determining, by the at least one processor, any awards for said complete hand, the credit balance being increasable by any determined awards; and (2) if a next play multiplier condition is satisfied, determining, by the at least one processor and based on the poker hand category with which said complete hand is associated, a multiplier usable in a hand corresponding to said complete hand in a next play of the card game; and (i) initiating, by the at least one processor, a payout associated with the credit balance after an actuation of a cashout button is received.

11. The method of claim 10, wherein the next play multiplier condition is satisfied when the wager is a designated wager.

12. The method of claim 10, which includes, for each complete hand, if said complete hand is associated with one of the plurality of different poker hand categories, determining, by the at least one processor, any awards for said complete hand based at least in part on a paytable.

13. The method of claim 12, which includes, for each complete hand, if said complete hand is associated with one of the plurality of different poker hand categories, determining, by the at least one processor, any awards for said complete hand based at least in part on any multiplier for said hand determined in a prior play of the card game.

14. The method of claim 10, wherein each poker hand category is associated with one of a plurality of different multipliers.

15. The method of claim 14, wherein a first poker hand category is associated with a first multiplier and a second more valuable poker hand category is associated with a second greater multiplier.

16. The method of claim 10, which includes:

placing, by the at least one processor, a second wager on the next play of the card game after a second actuation of the wager button is received;

repeating, by the at least one processor, (c) to (g)(3); and for each complete hand, if said complete hand is associated with one of the plurality of different poker hand categories:

(1) determining, by the at least one processor, any awards for said complete hand based at least in part on any multiplier for said hand determined in the prior play of the card game, the credit balance being increasable by any determined awards; and (2) if the next play multiplier condition is satisfied, determining, by the at least one processor and based on the poker hand category with which said complete hand is associated, a multiplier usable in a hand corresponding to said complete hand in a next play of the card game.

17. The method of claim 10, which includes randomly determining, by the at least one processor, the cards of the first hand from a set of a plurality of cards.

18. The method of claim 17, which includes, if fewer than all of the cards of the first hand are held:

completing, by the at least one processor, the first hand by, for each discarded card of the first hand, randomly selecting one of the remaining cards of the set of the plurality of cards and replacing said discarded card with the randomly-selected card; and for each of the one or more additional hands, completing, by the at least one processor, said additional hand by randomly selecting one or more of cards and adding said one or more randomly-selected cards to said additional hand, wherein if the one or more additional hands include a plurality of additional hands, the one or more cards added to the additional hands are randomly selected from different card sets.

19. The method of claim 10, which is at least partially provided through a data network.

20. The method of claim 19, wherein the data network is an internet.

* * * * *